US006012366A

United States Patent [19]

Shimizu

[11] Patent Number: 6,012,366

[45] Date of Patent: Jan. 11, 2000

[54] SLITTING MECHANISM OF A CARD CUTTING MACHINE

[75] Inventor: Tsuneo Shimizu, Tokyo, Japan

[73] Assignees: Itox Supply Co., Ltd.; Gunther Japan Ltd., both of Japan

[21] Appl. No.: 08/968,574

[22] Filed: Nov. 12, 1997

[30] Foreign Application Priority Data

Nov. 13, 1996 [JP] Japan ..... 8-315653
Nov. 13, 1996 [JP] Japan ..... 8-315654

[51] Int. Cl.[7] ..... B26D 7/06

[52] U.S. Cl. ..... 83/105; 83/145; 83/209; 83/408

[58] Field of Search ..... 83/408, 145, 162, 83/425.3, 425.4, 436.1, 436.15, 209, 422, 105, 407

[56] References Cited

U.S. PATENT DOCUMENTS

| | | | |
|---|---|---|---|
| 1,734,385 | 11/1929 | Bombard et al. | 83/162 |
| 1,963,369 | 6/1934 | Knowlton | 83/162 |
| 2,085,835 | 7/1937 | Strecker et al. | 83/162 |
| 3,169,430 | 2/1965 | De Mallie et al. | 83/408 |
| 3,716,695 | 2/1973 | Nakajima et al. | 83/408 |
| 4,168,643 | 9/1979 | Takimoto et al. | 83/422 |
| 4,207,667 | 6/1980 | D'Angelo et al. | 83/408 |
| 4,207,787 | 6/1980 | Lewallyn | 83/408 |
| 4,784,318 | 11/1988 | Bay | 83/408 |
| 5,067,309 | 11/1991 | Carlberg et al. | 53/520 |
| 5,303,623 | 4/1994 | Chiloff | 83/145 |
| 5,397,106 | 3/1995 | Hill | 83/408 |
| 5,429,024 | 7/1995 | Shimizu | 83/209 |

*Primary Examiner*—M. Rachuba
*Assistant Examiner*—Stephen Choi
*Attorney, Agent, or Firm*—Banner & Witcoff, Ltd.

[57] ABSTRACT

A slitting mechanism for a card cutting machine including a pair of rotating shafts having conveying rollers and cutting disks with cutting edges secured thereto. The slitting mechanism also includes a plate positioned in the space between adjacent cutting disks on one of the rotating shafts. The plate includes a sharp tip for contacting and dropping down chips caught in the space between adjacent cutting edges. Moreover, a sliding clutch is utilized to prevent rubbing and damaging of a sheet when the conveyance of the sheet is temporarily stopped. The sliding clutch is fitted on the drive shaft of the pair of rotating shafts for transferring power from a power source to the drive shaft. The clutch slides when a load is applied to the rotating shafts to stop the transfer of power to the rotating shafts and to prevent the conveying rollers from rubbing and damaging the sheets.

4 Claims, 3 Drawing Sheets

SLITTING MECHANISM OF A CARD CUTTING MACHINE

BACKGROUND OF THE INVENTION

1. Field of the Invention

The present invention relates to a slitting mechanism of a card cutting machine for manufacturing various kinds of cards, such as a name card, a member's card, a consultation card for a doctor, etc., and particularly, to a slitting mechanism for manufacturing cards by cutting a sheet on which plural cards are continuously printed by a desk top printer etc., into plural separated cards having a desired card size, and more particularly, to a slitting mechanism in which chips caught in a space between adjacent two movable cutting edges are certainly dropped down from the space, and the sheet is not rubbed by a slitter even when the conveyance of the sheet is temporarily stopped for cutting the sheet by a cutter.

2. Description of the Prior Art

This type of card cutting machine is, in general, composed of a box fur keeping a pile of sheets, on each of which plural cards are printed continuously by a desk top printer, etc., a pick-up roller for forwarding a sheet to a card cutting machine one by one from the top sheet of the pile kept into the box, a roller for conveying a sheet forwarded by the pick-up roller, and a cutting device including a slitter and a cutter, for cutting the sheet conveyed by the roller to a shape of card.

The slitter of the card cutting machine possesses a rotating shaft 18 for upper cutting edges and a rotating shaft 19 for lower cutting edges as mentioned in FIG. 2. On the rotating shaft 18, plural upper cutting disks 20, 20 . . . 20 are secured, and on the rotating shaft 19, plural lower cutting disks 21, 21 . . . 21 are secured, so as to leave a desired space between the adjacent cutting edges, to form plural pairs, each of which is assembled with the upper and lower cutting disks facing each other, and to mutually keep in touch at the edges of the assembled upper and lower cutting disks 20, 21.

In the afore-mentioned prior slitter, however chips are caught and kept in the spaces between two adjacent movable cutting disks (lower cutting disks 21, 21), and the operation of the lower cutting disks soon becomes impossible.

Moreover, in the afore-mentioned prior slitter, when the conveyance of the sheet 4 is temporarily stopped for cutting the sheet 4 by a cutter 11, the slitter still does not stop, and continues to move. Thus, the sheet is rubbed by the slitter, that is to say, by the upper and lower cutting disks 20, 21, or by the upper and lower conveying rollers 23, 24, and as a result, flaws appear on the sheet 4.

Accordingly, it is an object of the present invention to provide a slitting mechanism of a card cutting machine, in which chips caught in a space between adjacent two movable cutting disks (lower cutting disks) are certainly dropped down from the space.

Moreover, it is another object of the present invention to provide a slitting mechanism of a card cutting machine, in which a rub to a sheet by a slitter does not occur, even when the conveyance of the sheet temporarily stops for cutting the sheet by a cutter.

Furthermore, it is moreover, another object of the present invention to provide a slitting mechanism of a card cutting machine in which the disadvantages associated with the afore-described prior arts are overcome.

SUMMARY OF THE INVENTION

To achieve the above objects, according to the present invention there is provided a slitting mechanism in a card cutting machine composed of a box for keeping a pile of sheets, a pick-up roller for forwarding a sheet from a top sheet of a pile of sheets in the box, a roller for conveying the sheet forwarded by the pick-up roller, and a cutting device for cutting the sheet conveyed by the roller to a card shape, the cutting device including a cutter for cutting the sheet in a direction transverse to an axis extending along the path of travel of the top sheet. The slitting mechanism comprising upper and lower rotating shafts spaced apart from and extending parallel to each other, the rotating shafts extending transverse to the path of travel of the sheet. The slitting mechanism also including plural upper cutting disks fixed on the upper rotating shaft, and plural lower cutting disks fixed on the lower rotating shaft, each of the lower cutting disks having a cutting edge for contacting a cutting edge of a respective one of the upper cutting disks to form a pair of cooperating cutting disks. The slitting mechanism further including a plate having a sharp tip for clearing chips from a space between a pair of adjacent lower cutting disks. The plate being secured such that the sharp tip extends between the pair of adjacent lower cutting disks for making a stripe and a peak on a chip caught in the space, thereby shortening the effective width of the chip and allowing the chip to drop down from the space and away from the cutting disks.

Furthermore, to achieve the above objects, according to the another present invention, there is provided a slitting mechanism in a card cutting machine composed of a box for keeping a pile of sheets, a pick-up roller for forwarding a sheet from a top sheet of a pile of sheets in the box, a roller for conveying the sheet forwarded by the pick-up roller, and a cutting device for cutting the sheet conveyed by the roller to a card shape, the cutting device including a cutter for cutting the sheet in a direction transverse to an axis extending along the path of travel of the top sheet. The slitting mechanism comprising upper and lower rotating shafts spaced apart from and extending parallel to each other. The rotating shafts extending transverse to the axis extending along the path of travel of the sheet. The slitting mechanism also including plural upper cutting disks fixed on the upper rotating shaft, and plural lower cutting disks fixed on the lower rotating shaft, each of the lower cutting disks having a cutting edge for contacting a cutting edge of a respective one of the upper cutting disks to form a pair of cooperating cutting disks. The slitting mechanism further including a sliding clutch fitted on one of the rotating shafts so that rotational power is transferred to the one rotating shaft through the sliding clutch, such that when the conveyance of the top sheet is temporarily stopped and a load is placed on the one rotating shaft, the rotation of that shaft will be rapidly stopped and the sliding clutch will continue to run idle so that rubbing and damaging of the sheet does not occur.

DESCRIPTION OF THE PREFERRED EMBODIMENTS

The present invention will be described by way of preferred embodiment in connection with the accompanying drawings.

Figure 1:
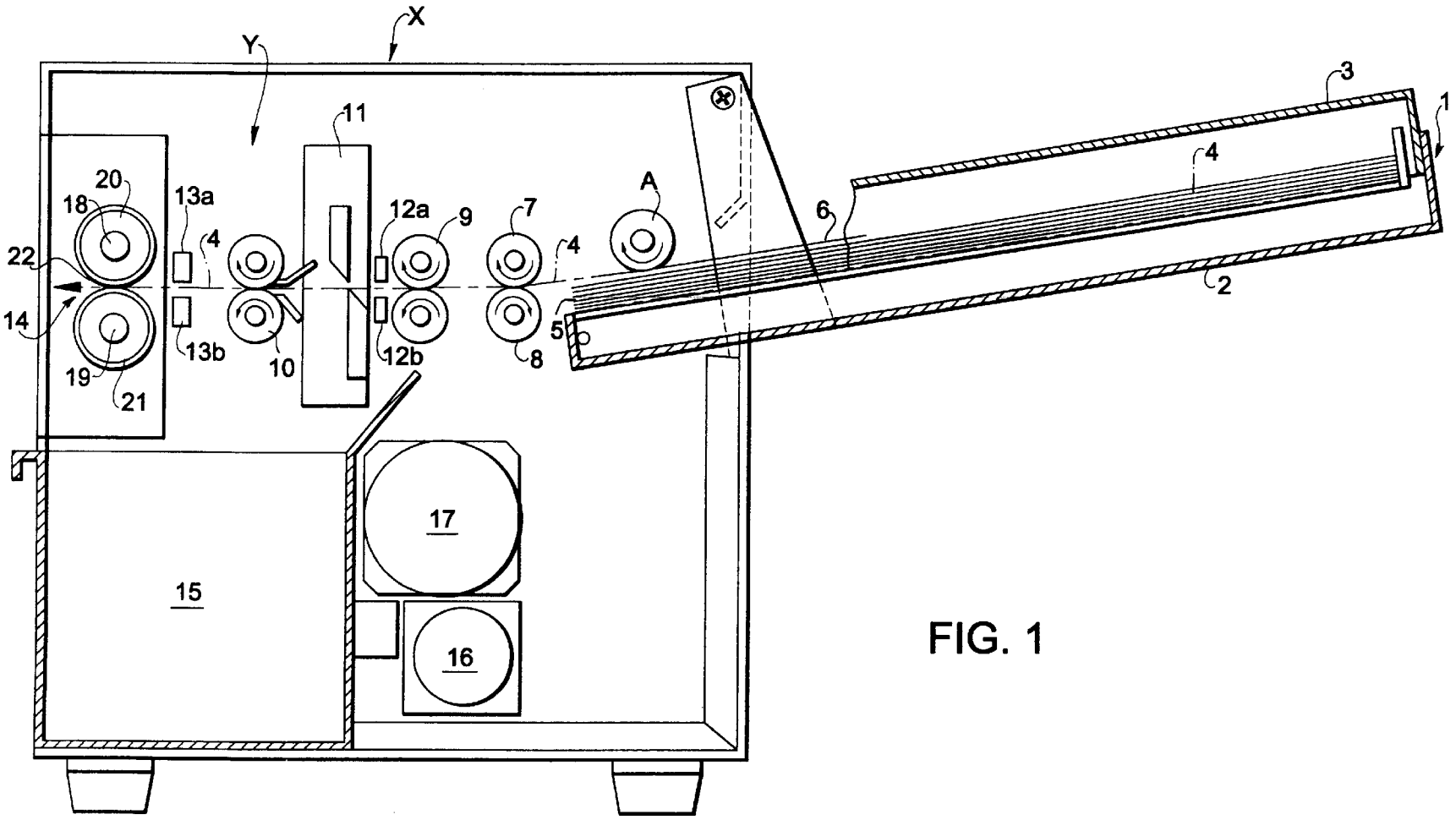
FIG. 1 is a sectional drawing of one embodiment of a card cutting machine of the present invention.

At first, a card cutting machine of the present invention is illustrated by using FIG. 1. In FIG. 1, numeral 1 shows a box for keeping a pile of sheets.

Box 1 is composed of body 2 and cap 3, and keeps pile of sheets 4 therein. Moreover, box 1 is installed in card cutting machine X so as to situate end 5 thereof into the lower part of pick-up roller. A, and to keep top sheet 6 of pile 4 in contact with pick-up roller A.

Pick-up roller A is a cylinder shaped roller produced by plastics, hard rubbers, soft rubbers, etc. The top sheet 6 of pile of sheets 4 is forwarded one by one into the inside of card cutting machine X by a friction force that occurs when the pick-up-roller A is rotated in the a direction of the shown arrow when it is in the contact with top sheet 6.

Numeral 7 shows a supplying roller which is rotated in the direction of the shown arrow. This supplying roller 7 supplys the top sheet 6 of the pile 4 forwarded by pick-up roller A, to a cutting device described below.

Under the supplying roller 7, a roller 8 for preventing a double supply, which is rotated in the direction of the shown arrow is installed. This roller 8 prevents the erroneous double supply of the sheet from the pile 4 through pick-up roller A.

Numeral 9 shows first conveying rollers formed by a pair of upper and lower rollers, which are made of plastics or hard rubbers etc. These rollers 9 are respectively rotated in the directions of the shown arrows, and convey top sheet 6 of pile 4 forwarded by pick-up roller A and supplying roller 7 by holding the sheet between a pair of upper and lower rollers.

In the present invention, second conveying rollers 10 are preferably installed in addition to the first conveying rollers 9 so that cutter 11 mentioned below is put between the rollers 9 and 10, in case that the margins are cut when name cards are manufactured, for example. But, in the case of post cards, in which it is not necessary to cut the margins, it is sufficient that merely conveying rollers 9 are singly installed at the entrance of cutter 11.

Numeral 11 shows a cutter of cutting device Y. This cutter 11 is composed of a pair of upper and lower edges, and works for cutting sheet 4 conveyed by first conveying roller 9 in a lateral direction by the indication of sensors 12*a*, 12*b*.

The sheet 4 cut in a lateral direction by cutter 11 is further conveyed by second conveying rollers 10, and is cut in a longitudinal direction by slitting mechanism 14 of cutting device Y with the indication of a pair of sensor 13*a*, 13*b*, thereby manufacturing cards having a desired size. Moreover, chips come from cutter 11 and slitting mechanism 14 are received into a wastebasket 15. In FIG. 1, numeral 16 is a main motor, and numeral 17 shows a step motor.

Figure 2:
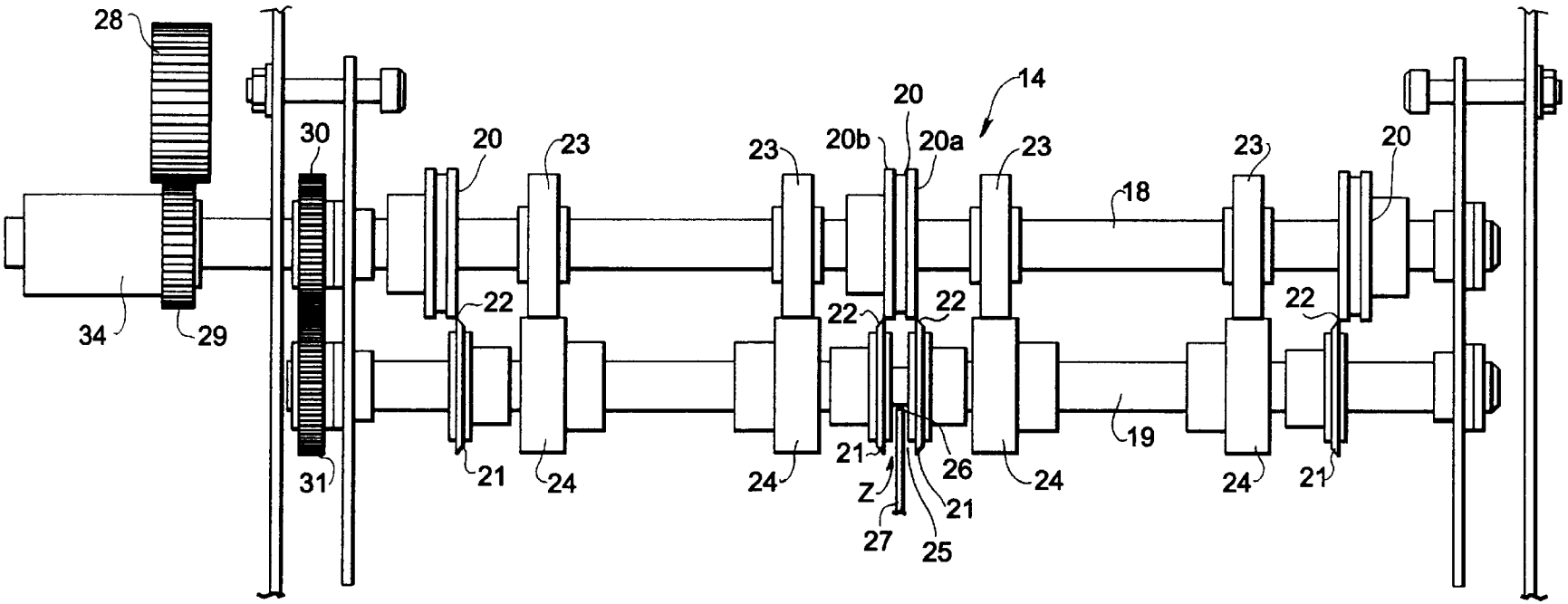
FIG. 2 is a plan drawing of one embodiment of a slitting mechanism of the present invention.
Figure 3:
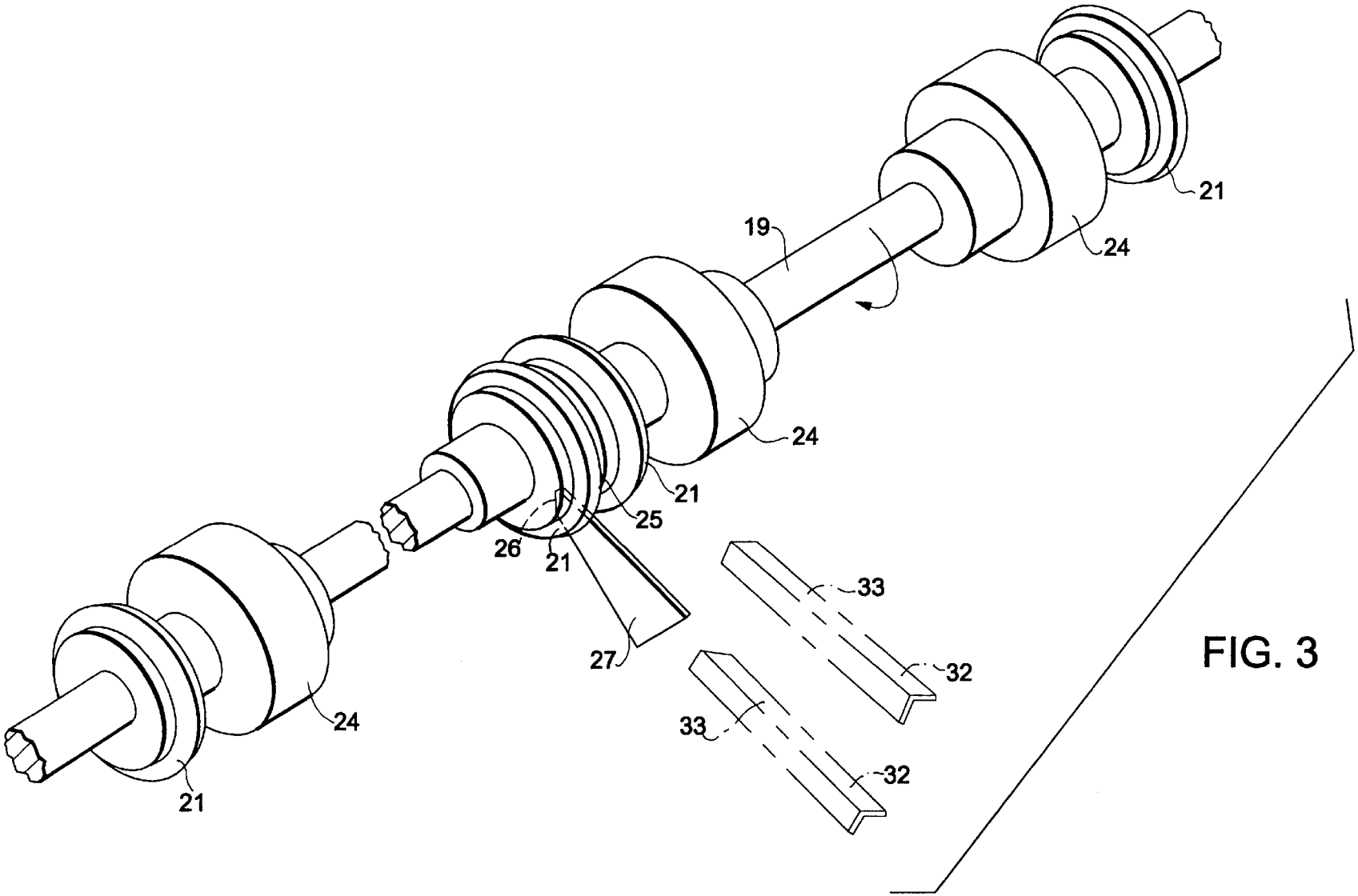
FIG. 3 is a partial perspective view of a slitting mechanism of the present invention.

The slitting mechanism 14 possesses a rotating shaft 18 for upper cutting disks and a rotating shaft 19 for the lower cutting edges, each of which is mutually rotated in the discussion of a reverse direction, as mentioned in FIG. 2 and FIG. 3. On the rotating shaft 18, plural upper cutting disks 20, 20 . . . 20 are secured, and on the rotating shaft 19, plural lower cutting disks 21, 21 . . . 21 are secured, so as to leave a desired space between the adjacent cutting disks, to form plural pairs, each of which is assembled with the upper and lower cutting disks 20 and 21 facing each other and to muturally keep in touch at the edges 22, 22 of the assembled upper and lower cutting disks 20, 21. Numerals 20*a*, 20*b* show fixed cutting disks 20, 20, respectively. Moreover, in FIG. 2, Z shows adjacent two pairs of upper and lower cutting disks.

The reason for providing the adjacent two pairs of upper and lower cutting disk Z in the slitting mechanism 14 resides in forming cards having a precise size by cutting the width of space 25 as a margin, when the sheet 4 is out to a card shape by cutting the sheet to a longitudinal direction.

Moreover, the afore-mentioned slitting mechanism 14 can provide an upper conveying roller 23 and lower conveying roller 24, as mentioned in the discussing FIG. 2.

The upper conveying roller 2 is secured on the rotating shaft 18 between the upper cutting disks 20, 20, and the lower conveying roller 24 is secured on the rotating shaft 19 between the lower cutting disks 21, 21. Opposing conveying rollers 23, 24 are positioned so that they face each other and are in contact with each other when a sheet is not in the slitting mechanism.

The slitting mechanism 14 is operated as follows. At first, the rotating power is given to the rotating shaft 18 for upper cutting disks from a power source not shown in the drawings through toothed wheels 28, 29 to rotate the rotating shaft 18. This rotating power is also given to the rotating shaft 19 for lower cutting disks through toothed wheels 30, 31. Thereafter the rotating shafts 18, 19 are mutually rotated in reverse directions, and as a result, a sheet 4 is conveyed with holding between the upper conveying roller 23 and the lower conveying roller 24, and is cut by the upper and lower cutting disks 20, 21 to a shape of card. At this time, chips are produced in the space 25, which are obtained by cutting the sheet as a margin. But, almost all chips are not dropped from the space 25, and are held and kept in the space 25, and as a result, cutting operation will be, soon, impossible.

The feature of the present invention resides in equipping a plate 27 for dropping down chips, having a sharp tip 26 in the space 25 between the adjacent two movable cutting disks (lower cutting disks 21,21).

Thereby, the chips 32 held in the space 25 are pushed up by a sharp tip 26 of the plate 27 to make a stripe and a peak 33 as shown in FIG. 3, and as a result, the width of the chips is narrowed, and chips are surely dropped down from the space 25. Further, in the present invention, the chips are dropped down by shortening the width thereof, and thus, they are automatically dropped downward without flying, different from a scratch-off system.

Furthermore, the present invention resides in fitting a sliding clutch 34 on a driving shaft of the rotating shaft 18 for upper cutting disks or the rotating shaft 19 for lower cutting disks (for example, on the driving shaft of the rotating shaft 18) as shown in FIG. 2 and in transmitting the driving force to the driving shaft through the sliding clutch. In the card cutting machine X of FIG. 1, the sheet 4 is, at first, cut by cutter 11 in a lateral direction, while the conveyance of the sheet 4 is temporarily stopped. However, in prior art slitting mechanisms, the rotating shafts 18 and 19 continue to rotate in spite of the fact that the sheet 4 is stopped. This rotation will continue until a load caused by the rubbing of the cutting disks 20, 21 and rollers 23, 24 on sheet 4 is put on the rotation of shafts 18, 19 (the rotation of the driving shaft) and the load overcomes and stops the rotation of the driven shaft. This results in the sheet 4 at least being rubbed and damaged in the area between the rotating upper and lower cutting disks 20, 21 and the rotating upper and lower conveying rollers 23, 24.

In the present invention, however, the rotating power is transmitted to the driving shaft through the sliding clutch 34. Therefore, the friction between the sheet and the cutting disks 20, 21 and the upper and lower conveying rollers 23, 24 is not relied upon to overcome the rotating force of the power source. Instead, when a load is applied to rotating shafts 18 and 19 as a result of the conveyance of sheet 4 being stopped, the clutch 34 slides and begins to spin freely so that the shaft is not driven while the sheet 4 is stopped. Accordingly, when this load is put on the rotation of the driving shaft, sliding clutch 34 begins to run idle and, the rotation of shafts 18, 19 is rapidly stopped without rubbing and damaging the sheet 4.

When the sheet 4 is released from stopping and conveyed again, the rotating power is transmitted to the driving shaft through the sliding clutch 34, and the driving shaft again starts to rotate.

Moreover, the conveying rollers used in the present invention, and shown in FIGS. 1, 2 and 3, are preferably fated by hard materials having a hardness of 60 degree or more by expressing with a rubber hardness index.

By using the rollers of hard materials in the present invention, the sheet 4 forwarded by the pick-up roller can be surely caught and exactly conveyed in the card cutting machine X. Moreover, when the sheet 4 is cut in the cutting device Y, it is surely kept and is precisely cut.

In addition, it is preferable to keep a narrower space than the thickness of the sheet 4 between the upper and lower rollers to easily pass the sheet 4 between the rollers.

The hard materials having a hardness of 60 or more degree by expressing with a rubber hardness index are exemplified as natural rubbers, synthetic rubbers such as styrene-butadiene rubber, chloroprene rubber, nitryl-butadiene rubber, urethane rubber, silicon rubber, fluoro-rubber, etc., synthetic resins, such as phenol resin, urea resin, melamine resin, polyester resin, epoxy resin, silicone resin, polyimide resin, urethane resin, vinyl chloride resin, polystyrene resin, ABS resin, ployurethane resin, polyethylene resin, polypropylene resin, polyamide, resin, polycarbonate resin, polyacetal resin, polyethylene terephthalate resin, urea resin etc., metals, such as carbon steel, brass, phosphor bronze, aluminum, aluminum alloy, zinc alloy, etc., woods, ceramics, glass and on.

The effects of the present invention is illustrated as follows.

The slitting mechanism of the card cutting machine of the present invention is that chips caught in a space between two adjacent movable cutting disks are certainly dropped down from the space.

Moreover, an advantage the slitting mechanism of the card cutting machine of the present invention is that a rub to the sheet by the slitting mechanism does not occur, even when the conveyance of the sheet temporarily stops for cutting the sheet by a cutter, and thus, clean cards without any damages can be manufactured.

Further, by using the rollers of hard material, the sheet is surely caught, exactly conveyed and precisely cut.

What is claimed is:

1. A slitting mechanism for use in a card cutting machine having a box for keeping a pile of sheets, a pick-up roller for forwarding a top sheet from the pile of sheets in the box, a roller for conveying the sheet forwarded by the pick-up roller, and a cutting device for cutting the sheet conveyed by the roller to a card shape, the cutting device including a cutter for cutting the sheet in a direction transverse to an axis extending along the path of travel of the top sheet, said slitting mechanism comprising upper and lower rotating shafts spaced apart from and extending parallel to each other, said rotating shafts extending transverse to the path of travel of the sheet, plural upper cutting disks fixed on said upper rotating shaft, and plural lower cutting disks fixed on said lower rotating shaft, each said lower cutting disk having a cutting edge for contacting a cutting edge of a respective one of said upper cutting disks to form a pair of cooperating cutting disks, and said slitting mechanism further including a plate having a sharp tip for clearing chips from a space between a pair of adjacent lower cutting disks, said plate being secured such that said sharp tip extends within said space between said pair of adjacent lower cutting disks so that said sharp tip will contact a chip caught in said space during operation of said slitting mechanism for making a stripe and a peak on the chip to shorten an effective width of the chip and allow the chip to drop down from the space and away from the cutting disks.

2. A slitting mechanism in a card cutting machine as claimed in claim 1, wherein an upper conveying roller is fixed on the upper rotating shaft between the upper cutting disks, and a lower conveying roller is fixed on the lower rotating shaft between the lower cutting disks for cooperating with said conveying roller on said upper rotating shaft, said conveying rollers being in contact with each other when said slitting mechanism is free of a sheet.

3. A slitting mechanism for use in a card cutting machine having a box for keeping a pile of sheets, a pick-up roller for forwarding a top sheet from the pile of sheets in the box, a roller for conveying the sheet forwarded by the pick-up roller, and a cutting device for cutting the sheet conveyed by the roller to a card shape, the cutting device including a cutter for cutting the sheet in a direction transverse to an axis extending along the path of travel of the top sheet, said slitting mechanism comprising upper and lower rotating shafts spaced apart from and extending parallel to each other, said rotating shafts extending transverse to the axis extending along said path of travel, plural upper cutting disks fixed on said upper rotating shaft, plural lower cutting disks fixed on said lower rotating shaft, each said lower cutting disk having a cutting edge for contacting a cutting edge of a respective one of said upper cutting disks to form a pair of cooperating cutting disks, a sliding clutch fitted on one of said rotating shafts so that the rotational power is transferred to said one of said rotating shafts through said sliding clutch, such that when the conveyance of the top sheet is temporarily stopped and a load is placed on said one of said rotating shafts, the sliding clutch will run idle and the rotation of said one of said rotating shafts will be rapidly stopped so that rubbing and damaging of the sheet does not occur, and a plate having a sharp tip for clearing chips from a space between a pair of adjacent lower cutting disks, said plate being secured such that said sharp tip extends within said space between said pair of adjacent lower cutting disks so that said sharp tip will contact a chip caught in said space during operation of said slitting mechanism for making a stripe and a peak on the chip to shorten an effective width of the chip and allow the chip to drop down from the space and away from the cutting disks.

4. A slitting mechanism in a card cutting machine as claimed in claim 3, wherein an upper conveying roller is fixed on the upper rotating shaft between the upper cutting disks, and a lower conveying roller is fixed on the lower rotating shaft between the lower cutting disks for cooperating with said upper conveying roller, said conveying rollers being in contact with each other when said slitting mechanism is free of a sheet.

* * * * *